US007748357B2

(12) United States Patent
Watanabe

(10) Patent No.: US 7,748,357 B2
(45) Date of Patent: Jul. 6, 2010

(54) CONTROL APPARATUS AND CONTROL METHOD FOR A VARIABLE VALVE TIMING MECHANISM

(75) Inventor: Satoru Watanabe, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 590 days.

(21) Appl. No.: 11/729,863

(22) Filed: Mar. 30, 2007

(65) Prior Publication Data

US 2007/0227484 A1 Oct. 4, 2007

(30) Foreign Application Priority Data

Mar. 31, 2006 (JP) ..... 2006-096676
Mar. 31, 2006 (JP) ..... 2006-096798

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,386,164 B1 * 5/2002 Mikame et al. ..... 123/90.17

FOREIGN PATENT DOCUMENTS

| | | | |
|---|---|---|---|
| JP | 06017618 A | * | 1/1994 |
| JP | 2001-12262 (A) | | 1/2001 |
| JP | 2001-65373 (A) | | 3/2001 |
| JP | 2004-19658 A | | 1/2004 |

OTHER PUBLICATIONS

JP 06017618 A, abstract, Jan. 1994.*

* cited by examiner

*Primary Examiner*—Zelalem Eshete
(74) *Attorney, Agent, or Firm*—Foley & Lardner LLP

(57) ABSTRACT

Control of a hydraulic type variable valve timing mechanism utilizing torque acting on a camshaft to transfer oil between an advance chamber and a retard chamber to cause a variation in a rotational phase of the camshaft, is implemented by computing a manipulated variable at each one cycle of the torque, based on the deviation between a detection value of the rotational phase and a target value thereof.

21 Claims, 8 Drawing Sheets

CONTROL APPARATUS AND CONTROL METHOD FOR A VARIABLE VALVE TIMING MECHANISM

BACKGROUND OF THE INVENTION

1. Field of the Invention

The present invention relates to a control apparatus for and a control method of a variable valve timing mechanism which changes a rotational phase of a camshaft relative to a crankshaft, to vary valve timing of an intake valve and/or an exhaust valve.

2. Description of the Related Art

Japanese Unexamined Patent Publication (Kokai) No. 2004-019658 discloses one typical example of a variable valve timing mechanism which utilizes a reaction force transmitted from an engine valve to a cam, to cause transfer of oil between an advance chamber and a retard chamber, thereby varying a rotational phase of a camshaft relative to a crankshaft.

Here, a direction on which cam torque acts is periodically reversed in synchronism with the engine rotation, and an oil transfer direction is determined depending on the direction on which the cam torque acts.

Accordingly, for example, even if a passageway for transferring the oil from the advance chamber toward the retard chamber is opened, the transfer of oil occurs from the advance chamber to the retard chamber only when the cam torque corresponding to the transfer direction is generated.

Therefore, if computation of a manipulated variable for a feedback control is carried out by a control means at every constant time, the computation of the manipulated variable might be repeated in a state where no transfer of oil occurs for the reason that the direction on which the cam torque acts does not correspond to a direction to which the oil is to be transferred. Further, if the computation of the manipulated variable is repeated without occurrence of transfer of the oil, the manipulated variable might be excessively changed since a deviation in the feedback controlling is not reduced, resulting in an occurrence of the overshooting or the hunting.

SUMMARY OF THE INVENTION

It is, therefore, an object of the present invention to overcome the above-mentioned defects encountered by the conventional variable valve timing mechanism.

Another object of the present invention is to provide a control technique for controlling a variable valve timing mechanism by which a manipulated variable for a feedback control can be prevented from being excessively set.

According to one aspect of the present invention, there is provided a control apparatus for a variable valve timing mechanism which changes a rotational phase of a camshaft relative to a crankshaft, to vary valve timing of a valve of an engine, which comprises: a first detecting section that detects the rotational phase; a setting section that sets a target value of the rotational phase; a second detecting section that detects computing timings in synchronism with a cycle of variation of torque acting on the camshaft; and a first manipulating section that computes, at the computing timing, a manipulated variable to be outputted to the variable valve timing mechanism based on a deviation of the rotational phase detected by the first detecting section from the target value.

According to another aspect of the present invention, there is provided a control method of a variable valve timing mechanism which changes a rotational phase of a camshaft relative to a crankshaft, to vary valve timing of a valve of an engine, which comprises the steps of: detecting the rotational phase; setting a target value of the rotational phase; detecting computing timings in synchronism with a cycle of variation of torque acting on the camshaft; computing a manipulated variable for the variable valve timing mechanism at each of the computing timings, based on a deviation of the detection value of the rotational phase from the target value; and outputting the manipulated variable to the variable valve timing mechanism.

The other objects, features and advantages of the invention will become understood from the following description with reference to the accompanying drawings.

DETAILED DESCRIPTION OF THE INVENTION

Figure 1:
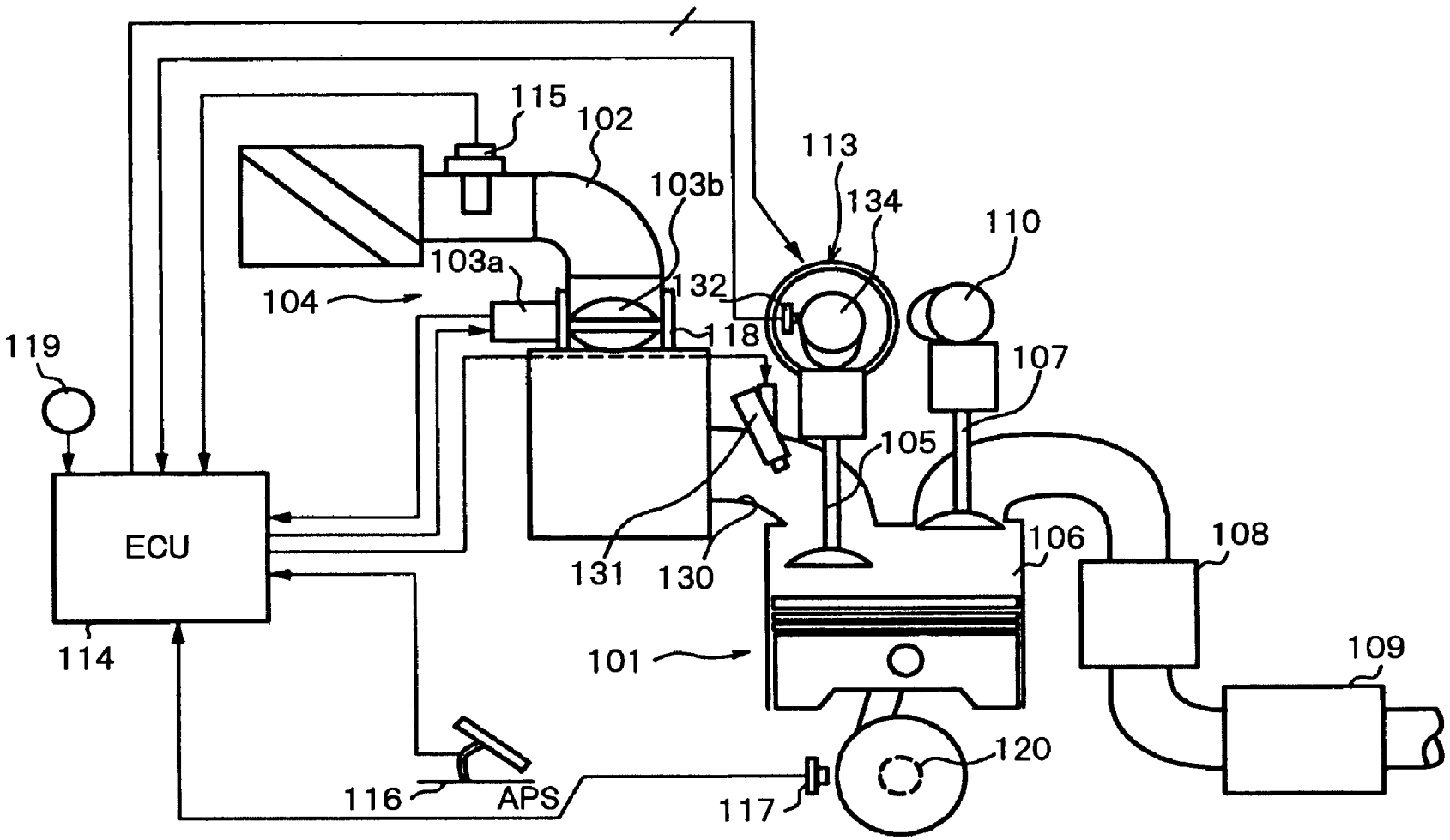
FIG. 1 is a systematic diagram showing an engine to which the present invention is applied.

FIG. 1 is a systematic diagram of an engine for vehicles.

In FIG. 1, in an intake pipe 102 of an engine 101, an electronically controlled throttle 104 is disposed. Then, air is sucked into a combustion chamber 106 via electronically controlled throttle 104 and an intake valve 105.

Electronically controlled throttle 104 comprises a throttle motor 103*a* and a throttle valve 103*b*.

A fuel injection valve 131 is disposed to an intake port 130 upstream of intake valve 105. Fuel injection valve 131 injects fuel toward intake valve 105, when it is driven to open based on an injection pulse signal from an engine control unit 114.

The fuel in combustion chamber 106 is ignited to be combusted by a spark ignition by an ignition plug (not shown in the figure).

The exhaust gas in combustion chamber 106 is discharged via an exhaust valve 107, and is purified by a front catalytic converter 108 and a rear catalytic converter 109, and thereafter, is emitted into the atmosphere.

Intake valve 105 and exhaust valve 107 are driven to open or close, respectively, by cams disposed to an intake camshaft 134 and an exhaust camshaft 110.

Here, to intake cam shaft 134, a variable valve timing mechanism 113 is disposed, which changes a rotational phase of intake camshaft 134 relative to a crankshaft 120, to continuously vary a center phase of an operating angle of intake valve 105.

Engine control unit 114 comprising a microcomputer, computes detection signals from various sensors in accordance with previously stored programs, to output control signals for electronically controlled throttle 104, variable valve timing mechanism 113, fuel injection valve 131 and the like.

As the various sensors, there are disposed an accelerator opening sensor 116 for detecting an accelerator opening, an air flow meter 115 for detecting an intake air quantity Q of engine 101, a crank angle sensor 117 for detecting a rotating angle of crankshaft 120, a throttle sensor 118 for detecting an amount of opening TVO of throttle valve 103*b*, a water temperature sensor 119 for detecting the temperature of cooling water for cooling engine 101, a cam sensor 132 for detecting a rotating angle of intake camshaft 134 and the like.

Here, crank angle sensor 117 outputs a reference crank angle signal REF at each reference crank angle position, and also, outputs a unit angle signal POS at every unit crank angle during rotation of crankshaft 120, and further, cam sensor 132 outputs a cam signal CAM at every reference cam angle during rotation of camshaft 110.

Here, engine 101 is an in-line four-cylinder engine, and the reference crank angle signal REF is set to be outputted at each time when crankshaft 120 is rotated by 180°, and the cam signal CAM is set to be outputted at each time when intake camshaft 134 is rotated by 90°.

Incidentally, intake camshaft 134 is rotated by ½ rotation per one rotation of crankshaft 120, and therefore, 90° in intake camshaft 134 is equivalent to 180° of crankshaft 120.

An operating stroke of each cylinder in engine 101 is changed over in order of intake→compression→expansion→exhaust at each 180° of crank angle. In four-cylinder engine 101, the operating stroke of each cylinder is set so that a phase thereof is shifted from each other by 180° of crank angle, and therefore, the cylinder at intake stroke changes from one to the other at each 180° of crank angle.

Accordingly, a reaction force transmitted from intake valve 105 to intake camshaft 134 is repetitively increased or decreased with 180° of crank angle as one cycle.

By measuring an angle of from output timing of the reference crank angle signal REF until the cam signal CAM is output, an advance angle amount of valve timing by variable valve timing mechanism 113 can be detected at each 180° of crank angle.

Next, the structure of variable valve timing mechanism 113 will be described based on FIG. 2.

In variable valve timing mechanism 113, a vane 201 connected to intake camshaft 134 is disposed in a housing 200 to which a cam pulley is disposed, so that two chambers are formed with vane 201 therebetween.

In the two chambers separated from each other by vane 201, one of the chambers is an advance chamber 202 for advancing the rotational phase of intake camshaft 134, and the other chamber is a retard chamber 203 for retarding the rotational phase of intake camshaft 134.

Then, according to a correlation between an oil quantity in advance chamber 202 and that in retard chamber 203, vane 201 performs the relative rotation in housing 200, and thus, the rotational phase of intake camshaft 134 relative to crankshaft 120 is changed, so that the valve timing of intake valve 105 is varied.

Namely, when the oil in retard chamber 203 is transferred into advance chamber 202, a pressure in advance chamber 202 is increased and vane 201 performs the relative rotation in a direction for increasing the volumetric capacity of advance chamber 202, so that the valve timing of intake valve 105 is advanced.

Contrary to the above, when the oil in advance chamber 202 is transferred into retard chamber 203, a pressure in retard chamber 203 is increased and vane 201 performs the relative rotation in a direction for increasing the volumetric capacity of retard chamber 203, so that the valve timing of intake valve 105 is retarded.

The transfer of oil between advance chamber 202 and retard chamber 203 is performed utilizing cam torque which is the reaction force transmitted from intake valve 105 to intake camshaft 134, and oil transfer directions and oil transfer quantities are controlled by a spool valve 210.

Advance chamber 202 is communicated with spool valve 210 via an advance oil passage 204, while retard chamber 203 being communicated with spool valve 210 via a retard oil passage 205.

Advance chamber 202 and retard chamber 203 are communicated with each other at halfway portions thereof by a connecting oil passage 206, and a bypass oil passage 207 is branched from a halfway portion of connecting oil passage 206 to be communicated with spool valve 210.

On a side of connecting oil passage 206, which is closer to advance oil passage 204 than the connecting portion of bypass oil passage 207, a check valve 208 for allowing the oil flow toward advance oil passage 204 is disposed.

Further, on a side of connecting oil passage 206, which is closer to retard oil passage 205 than the connecting portion of bypass oil passage 207, a check valve 209 for allowing the oil flow toward retard oil passage 205 is disposed.

To spool valve 210, along an axial direction thereof, advance oil passage 204, bypass oil passage 207 and retard oil passage 205 are connected in this sequence.

Figure 2:
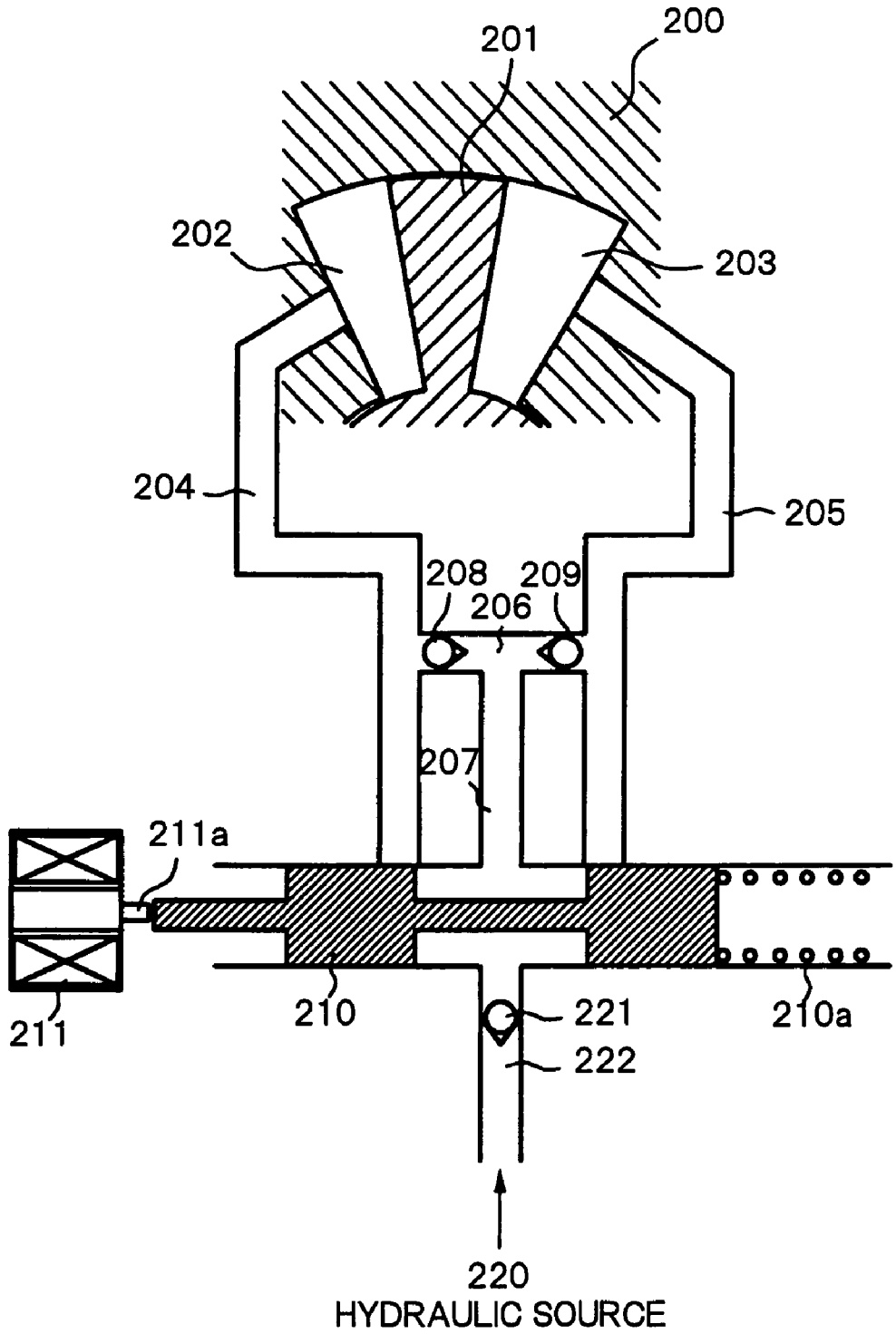
FIG. 2 is a diagram showing a hydraulic circuit of a variable valve timing mechanism provided for the engine.

Spool valve 210 is urged by a coil spring 210*a* toward a left direction in FIG. 2, and when the electric power is supplied to a solenoid 211, a rod 211*a* is displaced to a right direction in FIG. 2 to move spool valve 210 to the right direction in FIG. 2 against the urging force by coil spring 210*a*.

In a state where the electric power supply to solenoid 211 is stopped, spool valve 210 is positioned on an initial position by the urging force of coil spring 210*a*, and in this state, retard oil passage 205 is closed by spool valve 210, while bypass oil passage 207 and advance oil passage 204 being opened.

In the above initial position, the outflow of oil from retard chamber 203 is blocked by spool valve 210 and check valve 209, whereas the oil in advance chamber 202 can be transferred into retard chamber 203 through a passageway of advance oil passage 204→spool valve 210→bypass oil passage 207→check valve 209→retard oil passage 205.

Here, intake camshaft 134 is applied with torque (positive cam torque) in a direction for preventing the rotation thereof when intake valve 105 is opened, and is applied with torque (negative cam torque) in a direction for promoting the rotation thereof when intake valve 105 is closed.

Since vane 201 is connected to intake camshaft 134, a state where retard chamber 203 is pressurized via vane 201 and a state where advance chamber 202 is pressurized via vane 201 are alternately repeated.

Then, when advance chamber 202 is pressurized while retard chamber 203 being depressurized on the initial position, the oil is transferred from the inside of advance chamber 202 into retard chamber 203, so that the oil quantity in advance chamber 202 is decreased, whereas the oil quantity in retard chamber 203 is increased so that the rotational phase of intake camshaft 134 is retarded.

On the other hand, in a state where the electric power is supplied to solenoid 211 and spool valve 210 is displaced to the right direction in FIG. 2 so that advance oil passage 204 is closed by spool valve 210 while bypass oil passage 207 and retard oil passage 205 being opened, the oil in retard chamber 203 can be transferred into advance chamber 202 through a passageway of retard oil passage 205→spool valve 210→bypass oil passage 207→check valve 208→advance oil passage 204.

Then, when retard chamber 203 is pressurized while advance chamber 202 being depressurized in the above state, the oil is transferred from the inside of retard chamber 203 into advance chamber 202, so that the oil quantity in retard chamber 203 is decreased, whereas the oil quantity in advance chamber 202 is increased so that the rotational phase of intake camshaft 134 is advanced.

Further, as shown in FIG. 2, in a state where spool valve 209 is controlled to be on a neutral position, since retard oil passage 205 as well as advance oil passage 204 is closed by spool valve 210, the oil transfer from the inside of advance chamber 202 into retard chamber 203 and the oil transfer from the inside of retard chamber 203 into advance chamber 202 are both blocked, so that the rotational phase of intake camshaft 134 is held in the state at the time.

Namely, when spool valve 210 is displaced to the left direction from the neutral position shown in FIG. 2, the rotational phase of intake camshaft 134 is retarded, and when spool valve 210 is displaced to the right direction from the neutral position shown in FIG. 2, the rotational phase of intake camshaft 134 is advanced.

Engine control unit 114 controls a duty ratio of a duty signal which is a manipulated variable for controlling the electric power supply to solenoid 211, according to the deviation between a detection value of the rotational phase and a target value thereof.

Incidentally, the above feedback control is performed, for example by a proportional plus integral plus derivative action based on the above deviation.

However, the feedback control is not limited to the one based on the proportional plus integral plus derivative action. For example, the feedback control may be performed by only a proportional plus integral action, and further, it is also possible to apply a sliding mode control to the feedback control.

As described above, variable valve timing mechanism 113 is for changing the rotational phase of intake camshaft 134 by the oil transfer between retard chamber 203 and advance chamber 202.

Accordingly, in ideal, the rotational phase can be changed only by the oil transfer within the closed passageway without the necessity of using oil flown into variable valve timing mechanism 113 from a hydraulic source 220. However, since the oil leakage occurs during an operation of variable valve timing mechanism 113, in order to replenish an oil loss component due to this leakage, the oil from hydraulic source 211 is replenished to variable valve timing mechanism 113 via a replenishing passage 222 which is disposed with a check valve 221.

Figure 3:
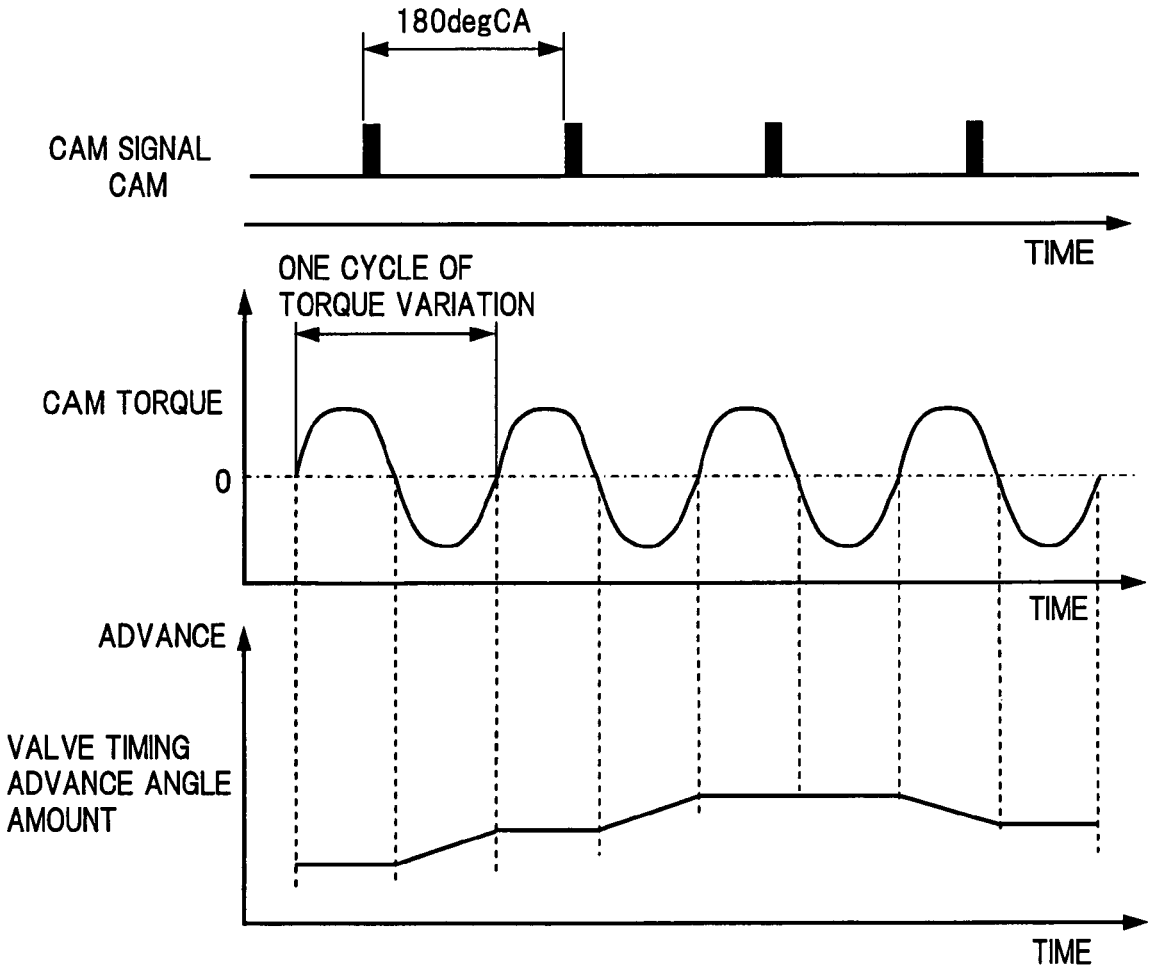
FIG. 3 is a time chart showing a correlation among a cam signal, cam torque and valve timing in the engine.

In variable valve timing mechanism 113, since the oil is transferred between retard chamber 203 and advance chamber 202 utilizing the cam torque, the oil transfer is not performed unless the cam torque corresponding to the direction to which the oil is to be transferred is applied, and accordingly, the rotational phase of intake camshaft 134 is not changed (refer to FIG. 3).

Then, if the duty ratio is repetitively computed based on the control deviation in the state where the oil transfer is not performed, the manipulated variable is increased by an integral action, and when a direction of the cam torque corresponds to the oil transfer direction, the excessive oil transfer is performed, resulting in the overshooting of rotational phase.

There will be described a first embodiment of rotational phase control capable of preventing such overshooting of rotational phase, based on a flowchart of FIG. 4.

Figure 4:
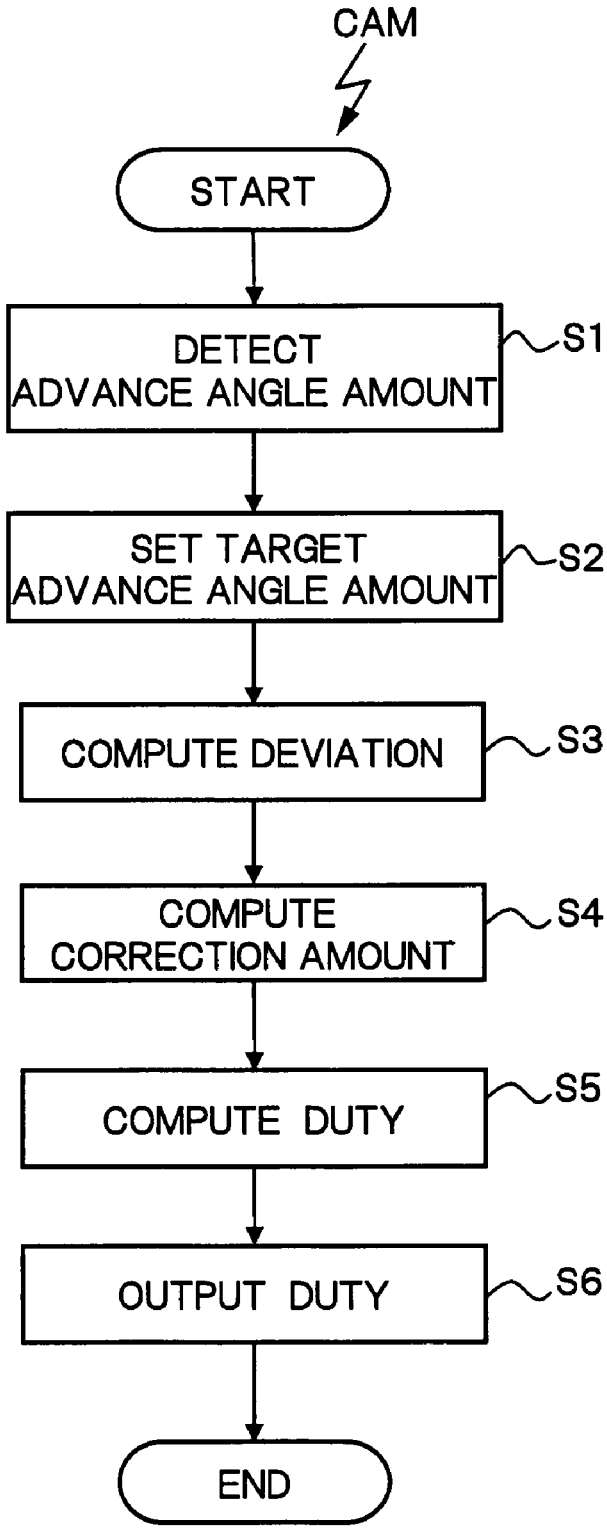
FIG. 4 is a flowchart showing a first embodiment of a control of the variable valve timing mechanism.

The flowchart of FIG. 4 shows a routine of computing to output the above described duty ratio, and is executed at each time when the cam signal CAM is output from cam sensor 132.

The cam signal CAM is output at each time when crankshaft 120 is rotated by 180°. Further, 180° of crankshaft 120 is equivalent to one cycle of cam torque variation in four-cylinder engine 101, and includes both a zone of increasing a lift amount of intake valve 105 to open it and a zone of decreasing the lift amount of intake valve 105 to close it (refer to FIG. 3).

In the zone of increasing the lift amount of intake valve 105, the positive cam torque in the direction for preventing the rotation of intake camshaft 134 is generated, whereas in the zone of decreasing the lift amount of intake valve, the negative cam torque in the direction of promoting the rotation of intake camshaft 134 is generated.

In variable valve timing mechanism 113, the rotational phase is advanced utilizing the negative cam torque while the rotational phase being retarded utilizing the positive cam torque.

Therefore, if the duty ratio is computed at each time when the cam signal CAM is output and the duty signal of this computed duty ratio is output to solenoid 211, after the oil of quantity appropriate to the newly given duty ratio is transferred, the duty ratio is then updated. Accordingly, it is possible to prevent that a duty is set at an excessive value in the feedback control inclusive of the integral action.

If the duty ratio is updated in a cycle shorter than the cycle in which the cam signal CAM is output, since the update of the duty ratio is performed in a cam torque generation state which does not correspond to the direction to which the rotational phase is to be changed, there is a possibility that the duty is excessively changed by the integral action.

However, as described in the above, if the duty ratio is computed in synchronism with the cycle of variation of cam torque, it can be reliably performed even in a low rotation state, that the duty ratio is updated after the oil is transferred according to the update result of the duty ratio.

Consequently, it is possible to prevent the duty ratio from being excessively changed by the integral action, so that the rotational phase can be stably controlled while avoiding the overshooting or the hunting.

Incidentally, the routine shown in the flowchart of FIG. 4 can be executed at each reference crank angle signal REF which is output in the same cycle, in place of the cam signal CAM from cam sensor 132.

Hereunder, the control content shown in the flowchart of FIG. 4 will be described in detail.

When the cam signal CAM outputs from cam sensor 132, firstly, in step S1, an amount of advance angle of the valve timing, which is varied by variable valve timing mechanism 113, is detected.

In the detection of the advance angle amount, an angle of rotation during a time from outputting of the reference crank angle signal REF from crankshaft 120 to outputting of the cam signal CAM from cam sensor 132 is measured, and the advance angle amount is updated at each time when the cam signal CAM is outputted by cam sensor 132.

In next step S2, a target value of the advance angle amount is determined based on operating conditions of engine 101 at the time. The operating conditions include an engine load, an engine rotating speed and the like.

In step S3, the deviation between the actual advance angle amount detected in step S1 and the target advance angle amount set in step S2 is computed.

In step S4, a correction amount is computed by the proportional plus integral plus derivative action based on the computed deviation.

In step S5, the correction amount is added to a base duty corresponding to the state where retard oil passage 205 and advance oil passage 204 are both closed by spool valve 210, to thereby determine a final duty ratio. The base duty is 50% for example.

In step S6, the duty signal of the duty ratio determined in step S5 is output to solenoid valve 211.

Next, the computation of the duty ratio is executed at each one cycle of cam torque variation in a low rotation region, while being executed at each constant time in a high rotation region. A second embodiment of rotational phase control will be described in accordance with flowcharts of FIG. 5 to FIG. 7.

Incidentally, the above constant time is 10 ms in the present embodiment.

Figure 5:
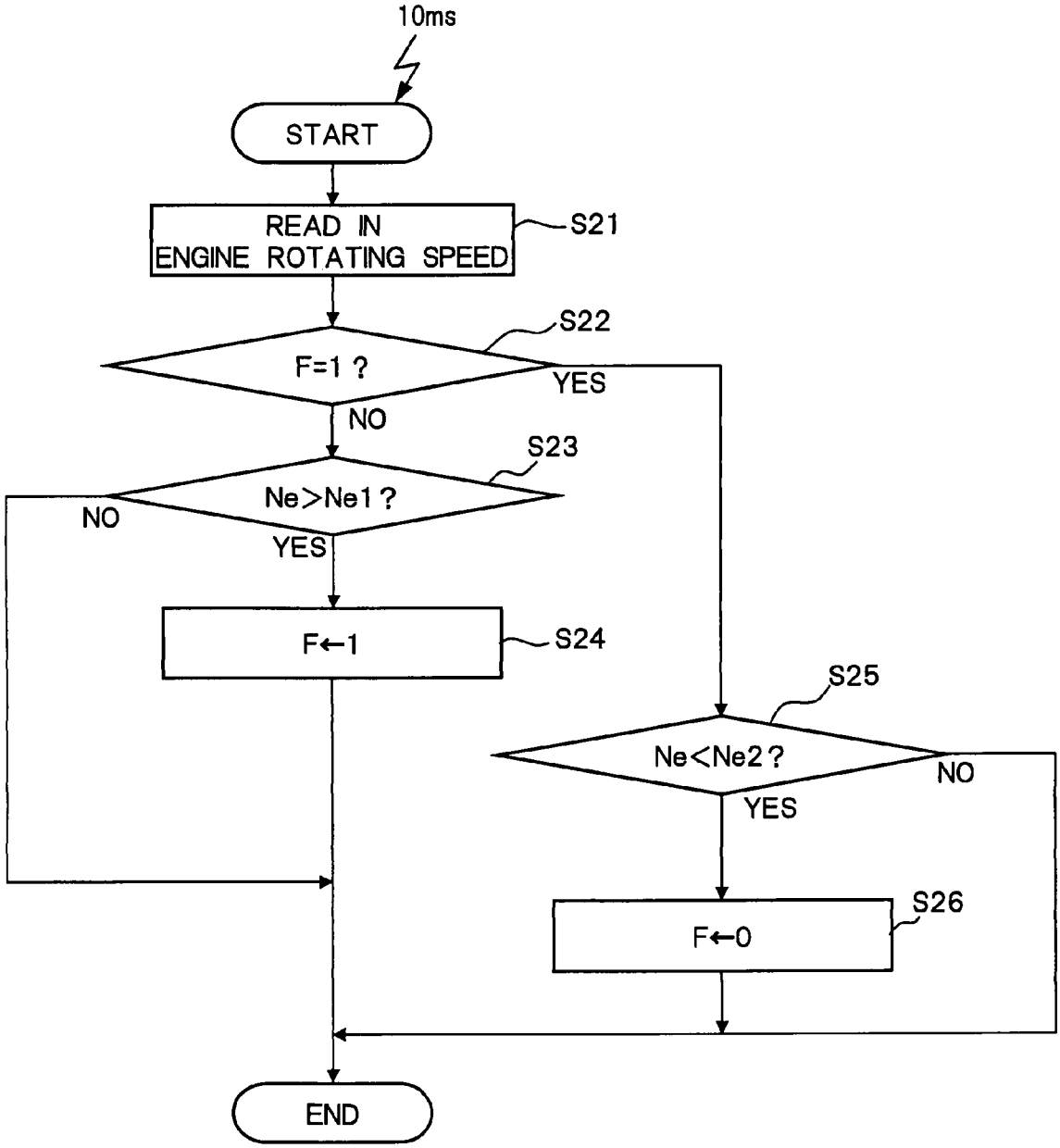
FIG. 5 is a flowchart showing the control mode switching in a second embodiment of the control of the variable valve timing mechanism.

A routine in the flowchart of FIG. 5 is executed at each 10 ms.

Firstly, in step S21, a detection result of engine rotating speed Ne is read in.

The engine rotating speed Ne is detected based on the reference crank angle signal REF or the unit angle signal POS output from crank angle sensor 117. To be specific, the engine rotating speed Ne is detected by measuring a generation cycle of the reference crank angle signal REF or the generation numbers of the unit angle signals POS during a constant period of time.

In step S22, it is judged whether or not a flag F is 1, which indicates whether or not a control in time synchronization is performed.

The flag F has an initial value of 0, and in a state of F=0, a control in synchronism with the cam torque variation is performed. When a condition for performing the control in time synchronization is established, 1 is set to the flag F as described below.

When the flag F=0, the routine proceeds to step S23, where it is judged whether or not the engine rotating speed Ne exceeds a first threshold Ne1.

Further, when the flag F=0 and also, the engine rotating speed Ne is equal to or less than the first threshold Ne1, the present routine is terminated while holding the flag F at 0, in order to perform the computation and output of the duty ratio at each one cycle of cam torque variation.

On the other hand, when it is judged in step S23 that the engine rotating speed Ne exceeds the first threshold Ne1, the routine proceeds to step S24.

In step S24, 1 is set to the flag F, in order to switch the computation and output of the duty ratio at each one cycle of cam torque variation to that at each constant time.

Further, in the case where it is judged in step S22 that 1 is set to the flag F, that is, in the case where the computation and output of the duty ratio is performed at each constant time, the routine proceeds to step S25, where it is judged whether or not the engine rotating speed Ne is lower than a second threshold Ne2 (Ne2<Ne1).

Then, when the engine rotating speed Ne is lower than the second threshold Ne2, the routine proceeds to step S26, where the flag F is reset to 0, and the computation and output of the duty ratio at each constant time is switched to that at each one cycle of cam torque variation.

On the other hand, when 1 is set to the flag F, and also, the engine rotating speed Ne is equal to or more than the second threshold Ne2, the present routine is terminated while holding the flag F at 1

As described in the above, the computation and output of the duty ratio is performed at each one cycle of cam torque variation in the low rotation region, while being performed at each constant time in the high rotation region. Incidentally, hysteresis characteristics is provided so as to avoid the hunting in the switching of control modes in the vicinity of a boundary of the rotation regions.

The first threshold Ne1 and the second threshold Ne2 are set to be in Ne2<Ne1 as described in the above. The second threshold Ne2 is set to be equal to or more than the engine rotating speed Ne at which a time cycle for when the computation and output of the duty ratio is performed at each constant time is in conformity with one cycle of cam torque variation. The first threshold Ne1 is set at a minimum value which is necessary and sufficient for suppressing the hunting, compared with the second threshold Ne2.

As a result, when the computation and output of the duty ratio is performed at each constant time, a computation cycle is not lower than one cycle of cam torque variation.

Figure 8:
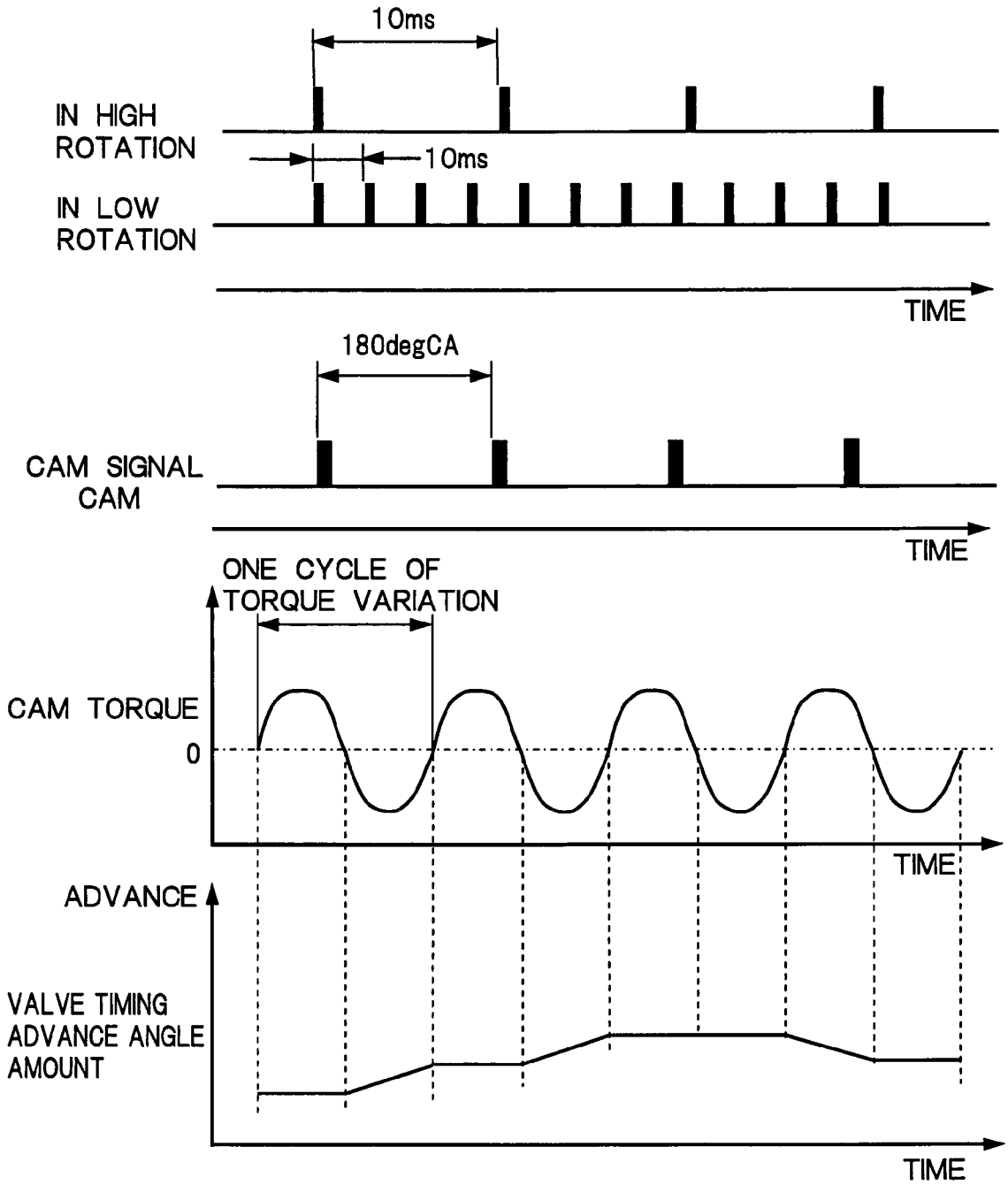
FIG. 8 is a time chart showing a correlation between a cycle of variation of the cam torque and a constant time period.

If one cycle of cam torque variation is made to be within the constant time which is a control cycle, both of a zone of responding to a command of advancing the valve timing (the generation state of negative cam torque) and a zone of responding to a command of retarding the valve timing (the generation state of positive cam torque) are necessarily included in the computation cycle (refer to FIG. 8).

Accordingly, it is possible to have next computing timing after the rotational phase corresponding to the updated duty ratio is changed, to thereby avoid that the duty ratio is excessively changed.

Here, also by performing the computation and output of the duty ratio in synchronism with the cycle of variation of cam torque, both of the zone of responding to the command of advancing the valve timing (the generation state of negative cam torque) and the zone of responding to the command of retarding the valve timing (the generation state of positive cam torque) can be included in the computation cycle. However, when the engine rotating speed is increased, the computation cycle is excessively shortened so that a computation load may be increased, and also, a response time to a valve timing change cannot be sufficiently ensured, so that the duty ratio may be excessively changed.

Therefore, in the high rotation region in which one cycle of cam torque variation is shorter than a previously set time period, the computation and output of the duty ratio is performed at the above time period, whereas in the low rotation region in which one cycle of cam torque variation is longer than the previously set time period, the computation and output of the duty ratio is performed in synchronism with the cycle of variation of cam torque in order to avoid that the duty ratio is repetitively updated in a state where the rotational phase is not changed.

Next, the details of the control in time synchronization and those of the control in synchronism with the cam torque variation will be described.

Figure 6:
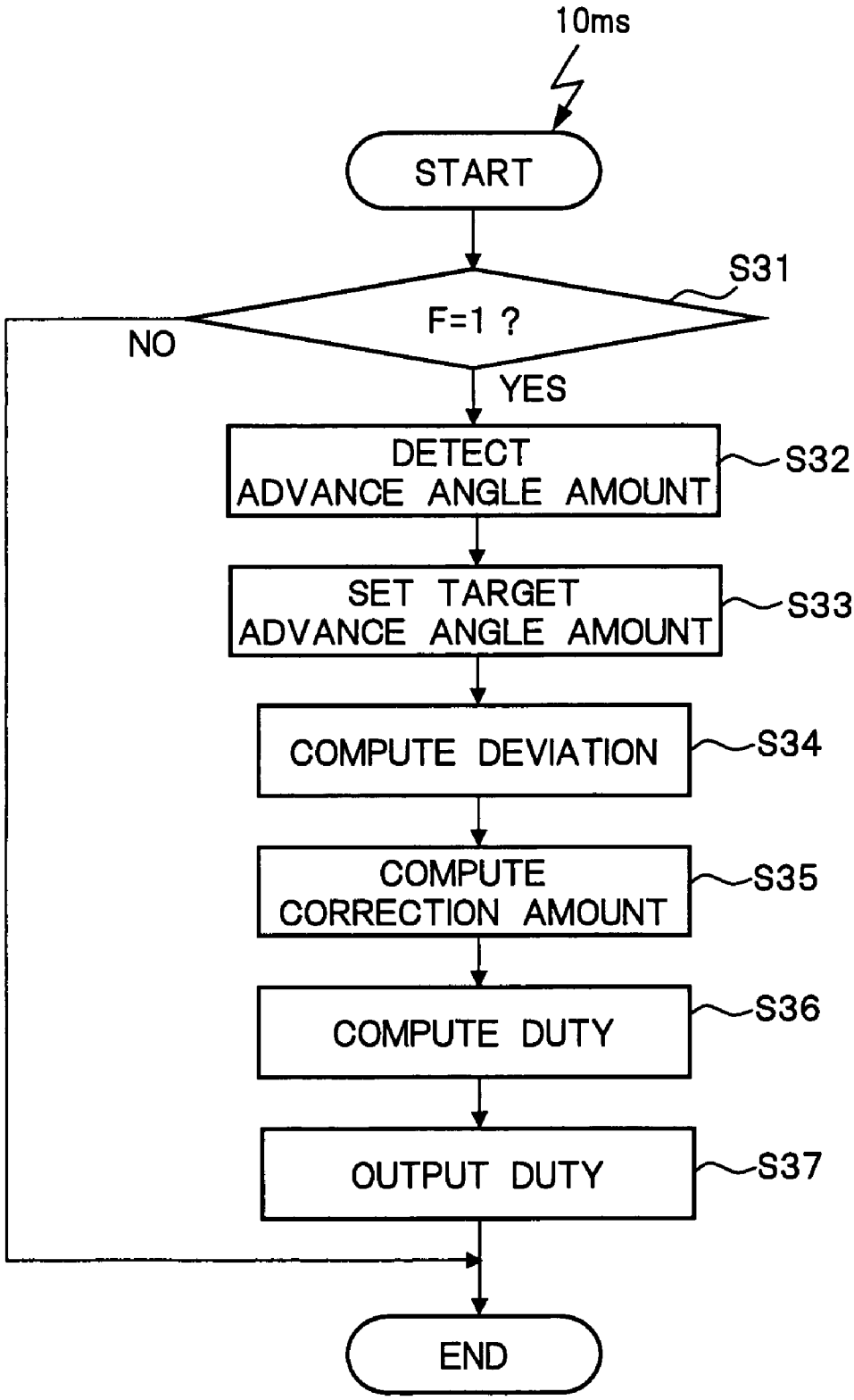
FIG. 6 is a flowchart showing a control in time synchronization in the second embodiment.

The flowchart of FIG. 6 shows the control in time synchronization which is executed at each 10 ms.

Firstly, in step S31, it is judged whether or not 1 is set to the flag F.

Here, in the case where 0 is set to the flag F, since the computation and output of the duty ratio is to be performed at each one cycle of cam torque variation, the present routine is terminated without proceeding to the subsequent steps.

On the other hand, in the case where 1 is set to the flag F, the routine proceeds to step S32 and the subsequent steps, in order to perform the computation and output of the duty ratio.

In step S32, the detection value of the advance angle amount of the valve timing by variable valve timing mechanism 113 is read in.

The advance angle amount is detected by measuring the rotating angle of from when the reference crank angle signal REF is output from crankshaft 120 until the cam signal CAM is output, and is updated at each time when the cam signal CAM is output.

In next step S33, the target value of the advance angle amount is determined based on the operating conditions of engine 101 at the time. The operating conditions include the engine load, the engine rotating speed and the like.

In step S34, the deviation between the actual advance angle amount detected in step S12 and the target advance angle amount set in step S13 is computed.

In step S35, a correction amount is computed by the proportional plus integral plus derivative action based on the computed deviation.

In step S36, a final duty ratio is determined by adding the correction amount to the base duty which corresponds to the state where retard oil passage 205 and advance oil passage 204 are both closed by spool valve 210. The base duty is 50% for example.

In step S37, the duty signal of the duty ratio determined in step S36 is output to solenoid 211.

Thus, in the case where 1 is set to the flag F, the computation and output of the duty ratio is performed at each 10 ms. However, the computation cycle is not limited to 10 ms.

Figure 7:
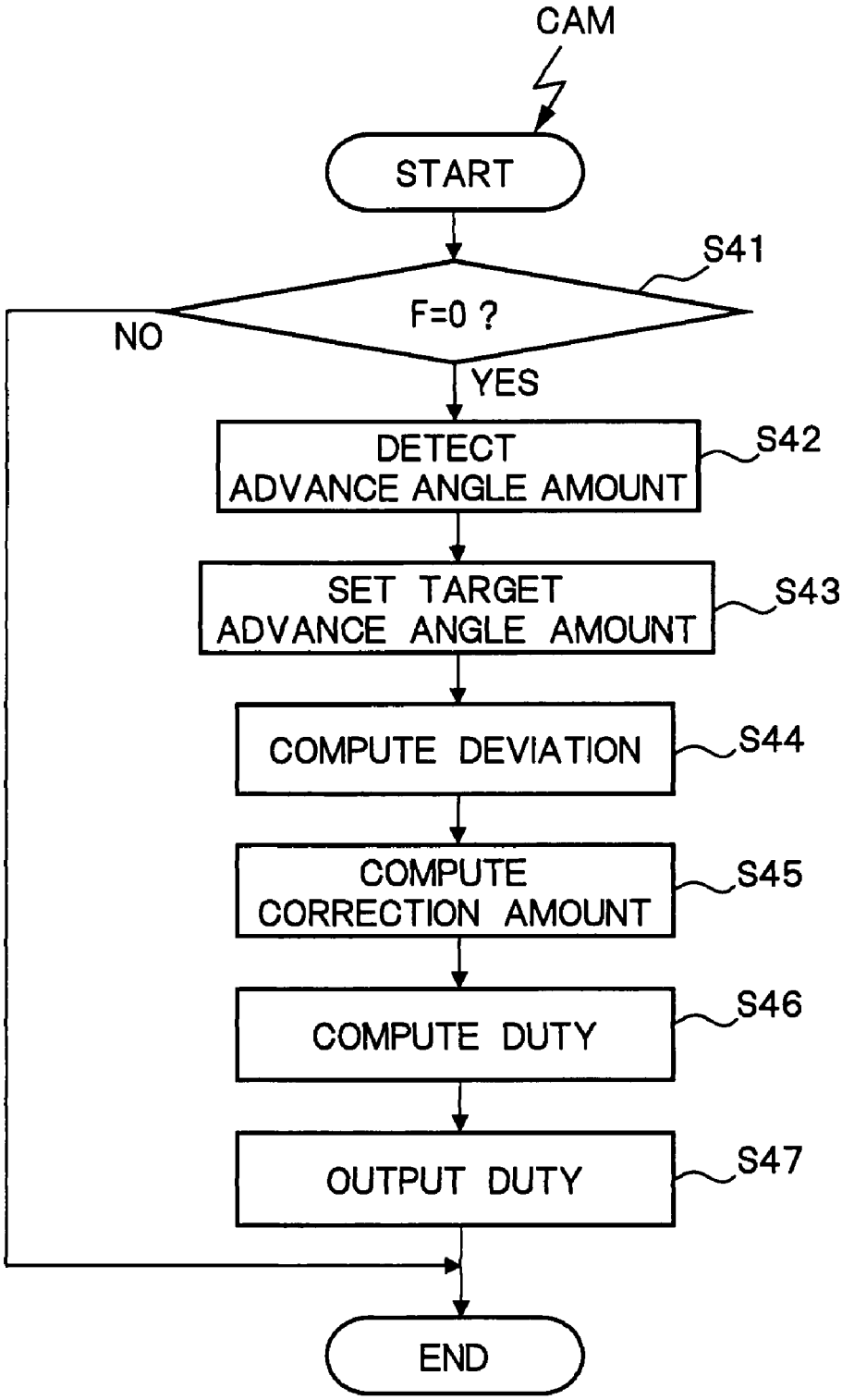
FIG. 7 is a flowchart showing a control in synchronous with a torque variation in the second embodiment.

The flowchart of FIG. 7 shows the control in synchronism with the cam torque variation which is executed at each time when the cam signal CAM is output from cam sensor 132.

The cam signal CAM is output at each time when crankshaft 120 is rotated by 180° Further, 180° of crankshaft 120 is equivalent to one cycle of cam torque variation in four-cylinder engine 101, and 180° of crankshaft 120 includes both of the zone of increasing the lift amount of intake valve 105 to open it and the zone of decreasing the lift amount of intake valve 105 to close it (refer to FIG. 8).

In the zone of increasing the lift amount of intake valve 105, the positive cam torque in the direction for preventing the rotation of intake camshaft 134 is generated, whereas in the zone of decreasing the lift amount of intake valve 105, the negative cam torque in the direction for promoting the rotation of intake camshaft 134 is generated.

In variable valve timing mechanism 113, the rotational phase is advanced utilizing the negative cam torque, while being retarded utilizing the positive cam torque.

Therefore, if the duty ratio is computed at each time when the cam signal CAM is output and the duty signal of the computed duty ratio is output to solenoid 211, after the oil of quantity appropriate to the newly given duty ratio is transferred, the duty ratio is then updated. Accordingly, it is possible to prevent that the duty is set at the excessive value in the feedback control inclusive of the integral action.

If the duty ratio is updated in the cycle shorter than the cycle in which the cam signal CAM is output, since the update of the duty ratio is performed in the cam torque generation state which does not correspond to the direction to which the rotational phase is to be changed, there is a possibility that the duty is excessively changed by the integral action.

However, as described in the above, if the duty ratio is computed in synchronism with the cycle of variation of cam torque, it can be reliably performed even in the low rotation state, that the duty ratio is updated after the oil is transferred according to the update result of the duty ratio.

Consequently, it is possible to prevent the duty ratio from being excessively changed by the integral action, so that the rotational phase can be stably controlled while avoiding the overshooting or the hunting.

Incidentally, the routine shown in the flowchart of FIG. 7 can be executed at each reference crank angle signal REF which is output in the same cycle, in place of the cam signal CAM from cam sensor 132.

When the cam signal CAM is output from cam sensor 132, firstly in step S41, it is judged whether or not 0 is set to the flag F.

Here, in the case where 1 is set to the flag F, since the computation and output of the duty ratio is to be performed at the constant time period, the present routine is terminated without proceeding to the subsequent steps.

On the other hand, in the case where 0 is set to the flag F, the routine proceeds to step S42 and the subsequent steps in order to perform the computation and output of the duty ratio.

The processing content in each of step S42 to step S47 is same as that in each of step S32 to step S37, and therefore, the description thereof is omitted here.

In the above respective embodiments, in the control in synchronism with the cycle of variation of cam torque, the duty ratio is computed to be output at each time when the cam signal CAM is output. However, both of the zone in which the cam torque is increasingly changed and the zone in which the cam torque is decreasingly changed may be included in the computation and output cycle of the duty ratio, and therefore, the computation and output cycle of the duty ratio is not limited to the output cycle of the cam signal CAM.

For example, the computation and output of the duty ratio can be performed at each time when the cam signal CAM is output for plural times (two to four times), in other words, at each cycle of n (integer equal to or larger than 1) times one cycle of cam torque variation.

Further, as the engine rotating speed is increased, the numeric value n can be changed to a larger value.

However, since the minimum value of the cycle of performing the computation and output of the duty ratio may be made one cycle of cam torque variation, the computation and output cycle does not need to be integral multiple of one cycle of cam torque variation, provided that the computation and output cycle is equal to or larger than the minimum cycle. Further, a phase relation between timing of computation and output, and the cam torque variation does not need to be constant.

Furthermore, the variable valve timing mechanism is not limited to the above described vane type variable valve timing mechanism, and if the variable valve timing mechanism is a variable valve timing mechanism in which a rotational phase is hard to be changed or is easy to be changed by an influence of a cam torque direction, a similar effect can be obtained by a control similar to the above described control.

Accordingly, the present invention can be applied to a variable valve timing mechanism using an electromagnetic brake, other than that of hydraulic type.

Still further, in the above embodiments, the variable valve timing mechanism which varies the valve timing of intake valve 105 has been shown. However, the present invention can also be applied to a variable valve timing mechanism which varies valve timing of exhaust valve 107.

Moreover, engine 101 is not limited to the four-cylinder engine, and the present invention can also be applied to a six-cylinder engine in which an intake stroke overlaps between cylinders.

The entire contents of Japanese Patent Application No. 2006-096676 filed on Mar. 31, 2006 and Japanese Patent Application No. 2006-096798 filed on Mar. 31, 2006, priorities of which are claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined by the appended claims and their equivalents.

I claim:

1. A control apparatus for a variable valve timing mechanism which changes a rotational phase of a camshaft relative to a crankshaft to vary valve timing of a valve of an engine, comprising:

a first detecting section configured to detect a current rotational phase of the camshaft;

a setting section configured to set a target value of the rotational phase;

a second detecting section configured to detect computing timings in synchronism with a cycle of variation of torque acting on the camshaft;

a first manipulating section configured to compute a manipulated variable to be outputted to the variable valve timing mechanism at the computing timings, based on a deviation of the current rotational phase detected by the first detecting section from the target value;

a second manipulating section configured to compute the manipulated variable to be outputted to the variable valve timing mechanism at a previously set time, based on the deviation of the current rotational phase detected by the first detecting section from the target value; and a switching section configured to permit the second manipulating section to implement computing and outputting of the manipulated variable in a high rotation region in which an engine rotating speed exceeds a threshold, while permitting the first manipulating section to implement computing and outputting of the manipulated variable in a low rotation region in which the engine rotating speed is equal to or less than the threshold.

2. The apparatus according to claim 1, wherein the switching section is configured to determine that the low rotation region includes a rotation region in which one cycle of variation of the torque is longer than the previously set time.

3. The apparatus according to claim 1, wherein the switching section is configured to determine the engine rotating speed incorporating hysteresis characteristics.

4. The apparatus according to claim 1, wherein the second detecting section is configured to detect the computing timings in a cycle that is "n" times of one cycle of variation of the torque acting on the camshaft, and wherein "n" indicates an integer equal to or larger than 1.

5. The apparatus according to claim 4, wherein the second detecting section is configured to set the integer "n" to be a larger numerical value in response to an increase in the engine rotating speed.

6. The apparatus according to claim 1, wherein the second detecting section includes a cam sensor configured for outputting a cam signal at each reference angle position of the camshaft, and configured to detect the computing timings based on outputting timings of the cam signal.

7. The apparatus according to claim 1, wherein the engine is a four-cylinder engine; and wherein the second detecting section is configured to detect one of the computing timings at every 180° of crank angle.

8. The apparatus according to claim 1, wherein the variable valve timing mechanism is a hydraulic type variable valve timing mechanism which is configured to utilize the torque acting on the camshaft to cause transfer of oil between an advance chamber and a retard chamber such that the rotational phase of the camshaft is changed.

9. The apparatus according to claim 8, wherein the variable valve timing mechanism comprises a spool valve capable of controlling a passageway and an amount of the transfer of oil between the advance chamber and the retard chamber, and a solenoid configured to drive the spool valve; and wherein the manipulated variable is a duty ratio of a duty signal for controlling an electrical power supply to the solenoid.

10. The apparatus according to claim 1, wherein the variable valve timing mechanism is provided for an intake valve and/or an exhaust valve.

11. A control apparatus for a variable valve timing mechanism which changes a rotational phase of a camshaft relative to a crankshaft, to vary valve timing of a valve of an engine, comprising:

first detecting means for detecting a current rotational phase of the camshaft;

setting means for setting a target value of the rotational phase;

second detecting means for detecting computing timings in synchronism with a cycle of variation of torque acting on the camshaft;

first manipulating means for computing a manipulated variable to be outputted to the variable valve timing mechanism at the computing timings, based on a deviation between the current rotational phase detected by the first detecting means and the target value;

second manipulating means for computing the manipulated variable to be outputted to the variable valve timing mechanism at a previously set time, based on the deviation between the current rotational phase and the target value; and switching means for permitting the second manipulating means to implement computing and outputting of the manipulated variable in a high rotation region in which an engine rotating speed exceeds a threshold, while permitting the first manipulating means to implement computing and outputting of the manipulated variable in a low rotation region in which the engine rotating speed is equal to or less than the threshold.

12. A method for controlling a variable valve timing mechanism which changes a rotational phase of a camshaft relative to a crankshaft, to vary valve timing of a valve of an engine, comprising the steps of:

detecting a current rotational phase of the camshaft;

setting a target value of the rotational phase;

detecting computing timings in synchronism with a cycle of variation of torque acting on the camshaft;

computing a manipulated variable for the variable valve timing mechanism at each of the computing timings, based on a deviation between the detected current rotational phase and the target value;

judging as to whether an engine rotating speed exceeds a threshold in a high rotation region or the engine rotating speed is equal to or less than the threshold in a low rotation region;

inhibiting computation of the manipulated variable at each of the computing timings in the high rotation region; and computing the manipulated variable for the variable valve timing mechanism at a previously set time, based on the deviation between the detected current rotational phase and the target value, in the high rotation region; and outputting the manipulated variable to the variable valve timing mechanism.

13. The method according to claim 12, wherein the low rotation region includes a rotation region in which one cycle of variation of the torque is longer than the previously set time.

14. The method according to claim 12, wherein the step of judging as to whether an engine rotating speed exceeds the threshold in the high rotation region or the engine rotating speed is equal to or less than the threshold in the low rotation region includes a judgment having hysteresis characteristics that is executed to decide as to whether the rotation region is at the low rotation region or the high rotation region.

15. The method according to claim 12, wherein the step of detecting the computing timings includes a step of detecting computing timings in a cycle that is "n" times of one cycle of variation of the torque acting on the camshaft, and wherein "n" is an integer equal to or larger than 1.

16. The method according to claim 15, further comprising the step of setting the integer "n" to be a larger numerical value in response to an increase in the engine rotating speed.

17. The method according to claim 12, wherein the step of detecting the computing timings comprises the steps of:

detecting a reference angle position of the camshaft; and detecting each of the computing timings, based on a result of detection of the reference angle position.

18. The method according to claim 12, wherein the engine is a four-cylinder engine, and wherein the step of detecting the computing timings detects each of the computing timings at each 180° of crank angle.

19. The method according to claim 12, wherein the variable valve timing mechanism is a hydraulic type variable valve timing mechanism which utilizes the torque acting on the camshaft to cause a transfer of oil between an advance chamber and a retard chamber such that the rotational phase of the camshaft is changed.

20. The method according to claim 19, wherein the variable valve timing mechanism is provided with a spool valve capable of controlling a passageway and an amount of oil between the advance chamber and the retard chamber, and a solenoid configured to drive the spool valve; and wherein the step of computing the manipulated variable computes a duty ratio of a duty signal for controlling an electrical power supply to the solenoid.

21. The method according to claim 12, wherein the variable valve timing mechanism is provided for an intake valve and/or an exhaust valve.

* * * * *